US009868493B2

(12) United States Patent
Ohtsuka et al.

(10) Patent No.: US 9,868,493 B2
(45) Date of Patent: Jan. 16, 2018

(54) INDEPENDENT TANK WITH CURVATURE CHANGE SECTION, AND MANUFACTURING METHOD FOR INDEPENDENT TANK

(71) Applicant: MITSUBISHI HEAVY INDUSTRIES, LTD., Tokyo (JP)

(72) Inventors: Hirotomo Ohtsuka, Tokyo (JP); Satoshi Miyazaki, Tokyo (JP); Michihisa Watanabe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 153 days.

(21) Appl. No.: 14/785,843

(22) PCT Filed: Jun. 5, 2014

(86) PCT No.: PCT/JP2014/065018
§ 371 (c)(1),
(2) Date: Oct. 20, 2015

(87) PCT Pub. No.: WO2014/203742
PCT Pub. Date: Dec. 24, 2014

(65) Prior Publication Data

US 2016/0068235 A1 Mar. 10, 2016

(30) Foreign Application Priority Data

Jun. 20, 2013 (JP) ..... 2013-129892

(51) Int. Cl.
*B63B 25/16* (2006.01)
*F17C 13/00* (2006.01)

(52) U.S. Cl.
CPC ..... *B63B 25/16* (2013.01); *F17C 13/00* (2013.01); *F17C 13/002* (2013.01);
(Continued)

(58) Field of Classification Search
CPC ..... B29L 2031/7156; F17C 2201/0123; F17C 2201/0109; F17C 2201/0104; F17C 13/002
See application file for complete search history.

(56) References Cited

U.S. PATENT DOCUMENTS 2,271,652 A 2/1942 Langvand et al.
2,280,501 A 4/1942 Stephenson
(Continued)

FOREIGN PATENT DOCUMENTS

CN 101687535 A 3/2010
EP 0666450 A1 8/1995
(Continued)

OTHER PUBLICATIONS

Office Action in CN Application No. 201480022432.0, dated Aug. 30, 2016.
(Continued)

*Primary Examiner* — Edwin Swinehart
(74) *Attorney, Agent, or Firm* — Kanesaka Berner and Partners LLP

(57) ABSTRACT

Provided is an independent tank, and a manufacturing method therefor, for which local bending stress occurring on the vicinity of a boundary portion (welded portion) can be reduced without increasing plate thickness. An independent tank has at least one curvature change portion in which the curvature along the axial direction of plate members that form the tank changes along the axial direction. Both the inner peripheral surface and the outer peripheral surface of the plate member on the small curvature side are not flush with respect to the inner peripheral surface and the outer peripheral surface of the plate member on the large curvature side. The plate thickness center of the plate member on the small curvature side is offset toward the radial direction inner side or the radial direction outer side with respect to
(Continued)

the plate thickness center of the plate on the large curvature side.

13 Claims, 9 Drawing Sheets

(52) U.S. Cl.
CPC ..... *F17C 2201/0104* (2013.01); *F17C 2201/0109* (2013.01); *F17C 2201/0123* (2013.01); *F17C 2201/0128* (2013.01); *F17C 2201/032* (2013.01); *F17C 2201/052* (2013.01); *F17C 2203/0604* (2013.01); *F17C 2203/0636* (2013.01); *F17C 2209/221* (2013.01); *F17C 2209/232* (2013.01); *F17C 2209/234* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2223/036* (2013.01); *F17C 2260/011* (2013.01); *F17C 2260/012* (2013.01); *F17C 2260/016* (2013.01); *F17C 2270/0105* (2013.01)

(56) References Cited

U.S. PATENT DOCUMENTS

| | | | | |
|---|---|---|---|---|
| 2,366,617 | A | | 1/1945 | Harris |
| 3,360,154 | A | * | 12/1967 | Turner, Jr. ..... F22B 37/221 220/327 |
| 4,398,646 | A | | 8/1983 | Pechacek |
| 5,577,810 | A | | 11/1996 | Abe et al. |
| 2003/0183638 | A1 | | 10/2003 | Minta et al. |
| 2008/0127654 | A1 | | 6/2008 | Darling et al. |
| 2010/0162939 | A1 | | 7/2010 | Morimoto |

FOREIGN PATENT DOCUMENTS

| | | | |
|---|---|---|---|
| EP | 1165270 | A1 | 1/2002 |
| EP | 1422013 | A1 | 5/2004 |
| GB | 888771 | A | 2/1962 |
| JP | 58-106068 | A | 6/1983 |
| JP | 5-240400 | A | 9/1993 |
| JP | 6-300192 | A | 10/1994 |
| JP | 3318099 | B2 | 8/2002 |
| JP | 2005-529286 | A | 9/2005 |
| JP | 2006-336839 | A | 12/2006 |
| JP | 4119813 | B2 | 7/2008 |
| JP | 2012-56429 | A | 3/2012 |
| WO | 00/32329 | A1 | 6/2000 |

OTHER PUBLICATIONS

Decision to Grant a Patent in JP Application No. 2013-129892, dated Mar. 8, 2016.
Office Action in KR Application No. 10-2015-7030227, dated Dec. 15, 2016.
International Search Report dated Sep. 2, 2014, corresponding to International application No. PCT/JP2014/065018.
Extended European Search Report in EP Application No. 14813916.5, dated Jun. 13, 2016.
R-PECHACEK: "Advanced Technology for Large Thick-Wall High-Pressure Vessels" , Mechanical ENG, vol. 99 No. 5, May 1, 1977, pp. 40-43.
Office Action in EP Application No. 14813916.5, dated May 19, 2017.

* cited by examiner

R 5500mm
h 50.0mm
H 25.0mm

σ0 = p*R/h
σ = SURFACE STRESS
Is = σs/σ0s
It = σt/σ0t
SUFFIXs = AXIAL (LONGITUDINAL) STRESS
SUFFIXt = AXIAL (LATITUDINAL) STRESS

INDEPENDENT TANK WITH CURVATURE CHANGE SECTION, AND MANUFACTURING METHOD FOR INDEPENDENT TANK

RELATED APPLICATIONS

The present application is a National Phase of International Application Number PCT/JP2014/065018, filed Jun. 5, 2014, which claims priority to Japanese Application Number 2013-129892, filed Jun. 20, 2013.

TECHNICAL FIELD

The present invention relates to an independent tank which is loaded in a ship, an offshore structure, or the like, has a curvature change portion on the exterior of the tank, and stores a liquid fuel (for example, high-pressure gas such as liquefied natural gas or liquefied petroleum gas), and a method of manufacturing the same.

BACKGROUND ART

As an independent tank, for example, independent tanks described in PTLs 1 and 2 are known.

CITATION LIST

Patent Literature

[PTL 1] Japanese Unexamined Patent Application Publication No. 6-300192

[PTL 2] Japanese Unexamined Patent Application Publication No. 5-240400

[PTL 3] Japanese Patent No. 4119813

SUMMARY OF INVENTION

Technical Problem

However, in the independent tanks described in PTLs 1 to 3, that is, in an independent tank 103 illustrated in FIG. 9, which includes a cylindrical portion 101 having a cylindrical shape and an end plate 102 having a hemispherical shape, as illustrated in FIG. 10, it is general that an inner peripheral surface 101*a* of the cylindrical portion 101 and an inner peripheral surface 102*a* of the end plate 102 are allowed to be flush with each other (in inner surface alignment) and the end plate 102 is joined to both ends of the cylindrical portion 101 by welding.

In addition, as illustrated in FIG. 11, an outer peripheral surface 101*b* of the cylindrical portion 101 and an outer peripheral surface 102*b* of the end plate 102 may be allowed to be flush with each other (in outer surface alignment) and the end plate 102 may be joined to both ends of the cylindrical portion 101 by welding.

However, the independent tank which stores a liquid fuel (for example, high-pressure gas such as liquefied natural gas and liquefied petroleum gas) receives stress due to the freight weight or sloshing and stress due to the expansion of the high-pressure gas from the inside of the tank. In the inner surface alignment illustrated in FIG. 10, in the vicinity of the boundary portion (welded portion) between the cylindrical portion 101 and the end plate 102, stress at the outer peripheral surfaces 101*b* and 102*b* as illustrated in FIG. 11 becomes higher than stress at the inner peripheral surfaces 101*a* and 102*a*. In the outer surface alignment illustrated in FIG. 11, in the vicinity of the boundary portion (welded portion) between the cylindrical portion 101 and the end plate 102, stress at the inner peripheral surfaces 101*a* and 102*a* becomes higher than stress at the inner peripheral surfaces 101*b* and 102*b*. That is, in the inner surface alignment illustrated in FIG. 10 or in the outer surface alignment illustrated in FIG. 11, in the vicinity of the boundary portion (welded portion) between the cylindrical portion 101 and the end plate 102, there is a difference in stress between the inner peripheral surfaces 101*a* and 102*a* and the outer peripheral surfaces 101*b* and 102*b*, and thus local bending stress occurs in the vicinity of the boundary portion (welded portion) between the cylindrical portion 101 and the end plate 102. In addition, this local bending stress also affects the boundary portion (welded portion) between the cylindrical portion 101 and the end plate 102 and thus reduces the fatigue life of the boundary portion (welded portion). Furthermore, in order to reduce this local bending stress, the cylindrical portion 101 and the end plate 102 may be increased in the plate thickness (may be allowed to be thick). However, there are problems in that it is difficult to perform manufacturing due to the performance of a machine tool when the plate thicknesses of the cylindrical portion 101 and the end plate 102 (particularly the cylindrical portion 101) are equal to or greater than a certain thickness, and the manufacturing cost is excessively increased.

In order to solve the problems, an object of the present invention is to provide an independent tank capable of reducing local bending stress that occurs in the vicinity of a curvature change portion (a boundary portion where the curvature of an end plate included in a tank changes) without increasing a plate thickness, and a method of manufacturing the same.

Solution to Problem

The present invention employs the following means in order to solve the problems.

An independent tank according to a first aspect of the invention includes at least one curvature change portion in which a curvature along an axial direction of plate members that form the tank changes along the axial direction, in which both an inner peripheral surface and an outer peripheral surface of the plate member having a lower curvature are not flush with an inner peripheral surface and an outer peripheral surface of the plate member having a higher curvature, respectively, and a plate thickness center of the plate member having a lower curvature is offset toward a radial inner side or a radial outer side with respect to a plate thickness center of the plate member having a higher curvature.

In the independent tank according to the first aspect, the difference between stress that occurs at the outer surface of the tank and stress that occurs at the inner surface of the tank in the curvature change portion of the tank becomes less than when the inner peripheral surface of the plate member having a lower curvature is flush with the inner peripheral surface of the plate member having a higher curvature and when the outer peripheral surface of the plate member having a lower curvature is flush with the outer peripheral surface of the plate member having a higher curvature.

Accordingly, local bending stress that occurs in the vicinity of the curvature change portion can be reduced without an increase in plate thickness.

It is further preferable that in the independent tank, the plate thickness center of the plate member having a lower curvature is offset toward the radial outer side from a position where stress that occurs at the outer surface of the tank and stress that occurs at the inner surface of the tank become equal to each other with respect to the plate thickness center of the plate member having a higher curvature.

According to the independent tank, in the curvature change portion, the stress that occurs at the outer surface of the tank is reliably (always) higher than the stress that occurs at the inner surface of the tank.

Accordingly, in a case where cracks and the like are generated in the tank, the cracks and the like are generated from the tank outer surface side. Therefore, cracks and the like can be easily and rapidly found from the tank outer surface side.

It is preferable that in the independent tank, the plate thickness center of the plate member having a lower curvature is offset toward the radial outer side by a manufacturing error from a position where stress that occurs at an outer surface of the tank and stress that occurs at an inner surface of the tank become equal to each other.

According to the independent tank, in the curvature change portion of the tank, the difference between the stress that occurs at the outer surface of the tank and the stress that occurs at the inner surface of the tank is further reduced.

Accordingly, local bending stress that occurs in the vicinity of the curvature change portion can be further reduced.

It is preferable that in the independent tank, the plate thickness center of the plate member having a lower curvature from the curvature change portion is offset toward the radial outer side from the plate thickness center of the plate member having a higher curvature to be at a position where stress that occurs at an outer surface of the tank and stress that occurs at an inner surface of the tank become equal to each other.

According to the independent tank, in the curvature change portion, the stress that occurs at the outer surface of the tank and the stress that occurs at the inner surface of the tank become equal to each other, and the difference between the stress that occurs at the outer surface of the tank and the stress that occurs at the inner surface of the tank becomes zero. Therefore, local bending stress that occurs in the vicinity of the curvature change portion can be removed.

It is preferable that in the independent tank, a joint portion between the plate member having a lower curvature and the plate member having a higher curvature is shifted toward a side of the plate member having a higher curvature from the curvature change portion between the plate member having a lower curvature and the plate member having a higher curvature.

According to the independent tank, concentration of local bending stress on the vicinity of the joint portion between the plate member having a lower curvature and the plate member having a higher curvature can be avoided, and thus the fatigue life of the joint portion can be prolonged.

It is preferable that in the independent tank, the plate member having a lower curvature has a cylindrical shape, and the plate member having a higher curvature is an end plate.

It is preferable that the independent tank is loaded on a ship or an offshore structure.

A ship according to a second aspect of the present invention includes the independent tank according to any of the above descriptions loaded thereon.

In the ship according to the second aspect, since the independent tank capable of reducing local bending stress that occurs in the vicinity of a curvature change portion without increasing a plate thickness is loaded, an increase in the ship weight can be avoided and the reliability of the ship can be enhanced.

A method of manufacturing an independent tank according to a third aspect of the present invention is a method of manufacturing an independent tank which includes at least one curvature change portion in which a curvature along an axial direction of plate members that form the tank changes along the axial direction, the method including the processes of: preparing the plate member having a lower curvature so that both an inner peripheral surface and an outer peripheral surface of the plate member having a lower curvature are not flush with an inner peripheral surface and an outer peripheral surface of the plate member having a higher curvature, respectively, and a plate thickness center of the plate member having a lower curvature is offset toward a radial inner side or a radial outer side with respect to a plate thickness center of the plate member having a higher curvature; and joining the plate member having a lower curvature and the plate member having a higher curvature together.

According to the independent tank which is manufactured by using the method of manufacturing an independent tank according to the third aspect, the difference between stress that occurs at the outer surface of the tank and stress that occurs at the inner surface of the tank in the curvature change portion of the tank becomes less than when the inner peripheral surface of the plate member having a lower curvature is flush with the inner peripheral surface of the plate member having a higher curvature and when the outer peripheral surface of the plate member having a lower curvature is flush with the outer peripheral surface of the plate member having a higher curvature.

Accordingly, local bending stress that occurs in the vicinity of the curvature change portion can be reduced without an increase in plate thickness.

A method of manufacturing an independent tank according to a fourth aspect of the present invention is a method of manufacturing an independent tank which includes at least one curvature change portion in which a curvature along an axial direction of plate members that form the tank changes along the axial direction, the method including the processes of: preparing the plate member having a lower curvature so that both an inner peripheral surface and an outer peripheral surface of the plate member having a lower curvature are not flush with an inner peripheral surface and an outer peripheral surface of the plate member having a higher curvature, respectively, and a plate thickness center of the plate member having a lower curvature is offset toward a radial outer side from a position where stress that occurs at an outer surface of the tank and stress that occurs at an inner surface of the tank become equal to each other, with respect to a plate thickness center of the plate member having a higher curvature; and joining the plate member having a lower curvature and the plate member having a higher curvature together.

According to the independent tank which is manufactured by using the method of manufacturing an independent tank according to the fourth aspect, in the curvature change portion, the stress that occurs at the outer surface of the tank is reliably (always) higher than the stress that occurs at the inner surface of the tank.

Accordingly, in a case where cracks and the like are generated in the tank, the cracks and the like are generated from the tank outer surface side. Therefore, cracks and the like can be easily and rapidly found from the tank outer surface side.

A method of manufacturing an independent tank according to a fifth aspect of the present invention is a method of manufacturing an independent tank which includes at least one curvature change portion in which a curvature along an axial direction of plate members that form the tank changes along the axial direction, the method including the processes of: preparing the plate member having a lower curvature so that both an inner peripheral surface and an outer peripheral surface of the plate member having a lower curvature are not flush with an inner peripheral surface and an outer peripheral surface of the plate member having a higher curvature, respectively, and a plate thickness center of the plate member having a lower curvature is offset by a margin of a manufacturing error toward a radial outer side from a position where stress that occurs at an outer surface of the tank and stress that occurs at an inner surface of the tank become equal to each other, with respect to a plate thickness center of the plate member having a higher curvature; and joining the plate member having a lower curvature and the plate member having a higher curvature together.

According to the independent tank which is manufactured by using the method of manufacturing an independent tank according to the fifth aspect, in the curvature change portion of the tank, the difference between the stress that occurs at the outer surface of the tank and the stress that occurs at the inner surface of the tank is further reduced.

Accordingly, local bending stress that occurs in the vicinity of the curvature change portion can be further reduced.

A method of manufacturing an independent tank according to a sixth aspect of the present invention is a method of manufacturing an independent tank which includes at least one curvature change portion in which a curvature along an axial direction of plate members that form the tank changes along the axial direction, the method including the processes of: preparing the plate member having a lower curvature so that both an inner peripheral surface and an outer peripheral surface of the plate member having a lower curvature are not flush with an inner peripheral surface and an outer peripheral surface of the plate member having a higher curvature, respectively, and a plate thickness center of the plate member having a lower curvature is offset toward a radial outer side from a plate thickness center of the plate member having a higher curvature to be at a position where stress that occurs at an outer surface of the tank and stress that occurs at an inner surface of the tank become equal to each other; and joining the plate member having a lower curvature and the plate member having a higher curvature together.

According to the independent tank which is manufactured by using the method of manufacturing an independent tank according to the sixth aspect, in the curvature change portion, the stress that occurs at the outer surface of the tank and the stress that occurs at the inner surface of the tank become equal to each other, and the difference between the stress that occurs at the outer surface of the tank and the stress that occurs at the inner surface of the tank becomes zero. Therefore, local bending stress that occurs in the vicinity of the curvature change portion can be removed.

It is preferable that in the method of manufacturing an independent tank, a joint portion between the plate member having a lower curvature and the plate member having a higher curvature is shifted toward a side of the plate member having a higher curvature from the curvature change portion between the plate member having a lower curvature and the plate member having a higher curvature.

According to the method of manufacturing an independent tank, concentration of local bending stress on the vicinity of the joint portion between the plate member having a lower curvature and the plate member having a higher curvature can be avoided, and thus the fatigue life of the joint portion can be prolonged.

Advantageous Effects of Invention

According to the independent tank which is manufactured by the independent tank and the method of manufacturing the same according to the present invention, local bending stress that occurs in the vicinity of the curvature change portion can be reduced without an increase in plate thickness. Therefore, an effect of enhancing the fatigue life of the independent tank is exhibited.

DESCRIPTION OF EMBODIMENTS

Hereinafter, an independent tank according to an embodiment of the present invention will be described with reference to FIGS. 1 and 2.

Figure 1:
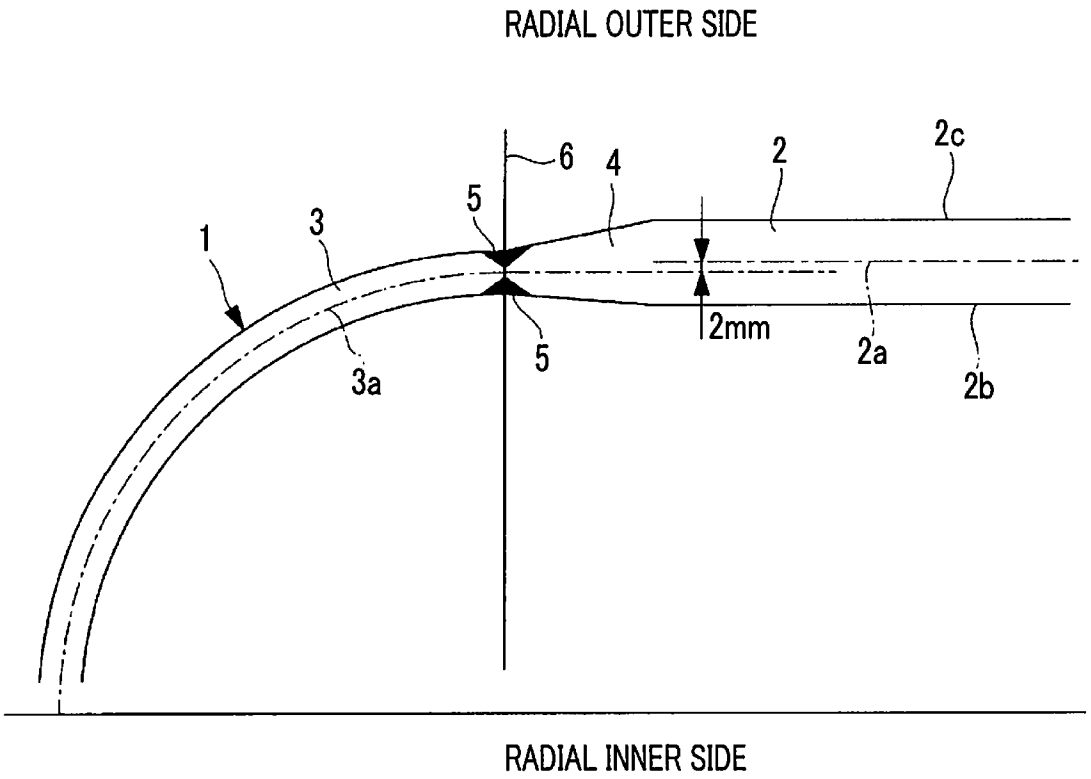
FIG. 1 is an enlarged sectional view illustrating main parts of an independent tank according to an embodiment of the present invention.

An independent tank 1 according to this embodiment stores liquefied natural gas or the like therein, and as illustrated in FIG. 1, includes a cylindrical portion (a plate member having a lower curvature) 2 having a cylindrical shape and an end plate (a plate member having a higher curvature) 3 which closes both end openings of the cylindrical portion 2 and has a hemispherical shape.

Figure 2:
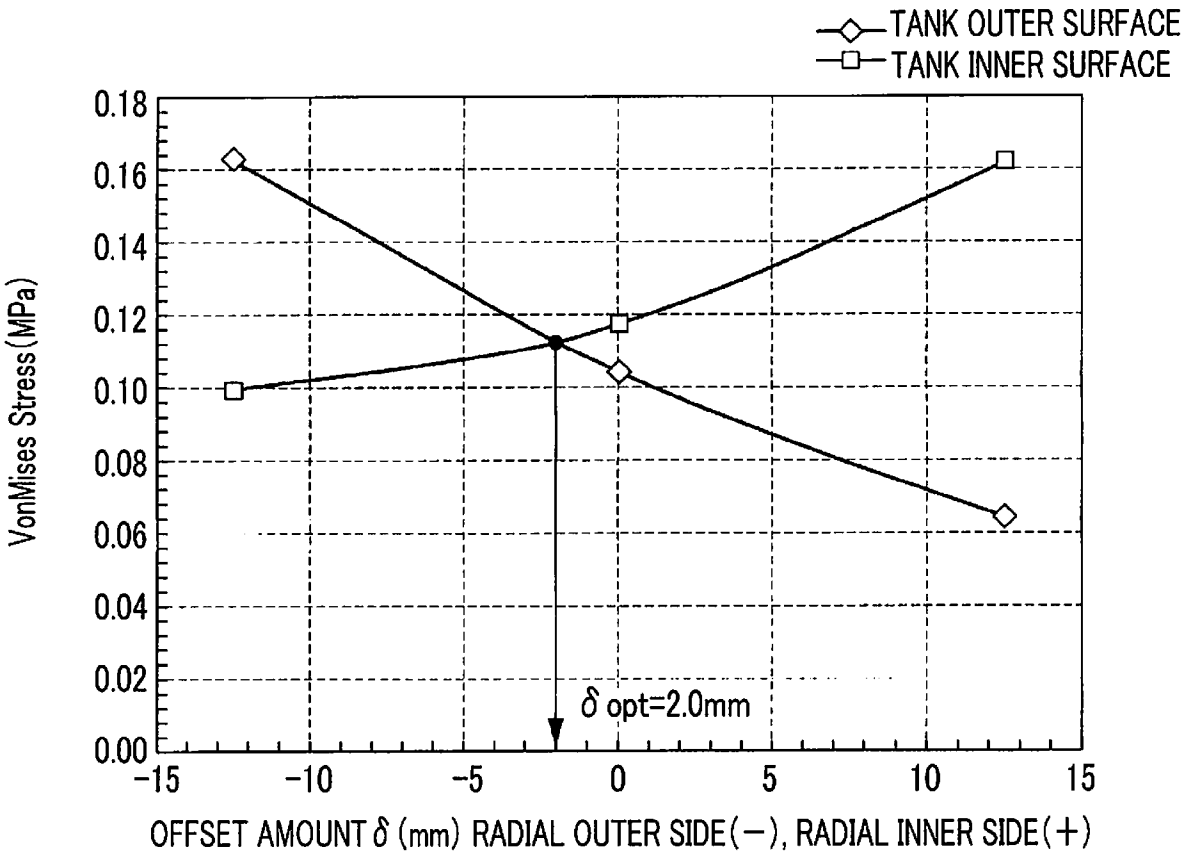
FIG. 2 is a graph showing the results analyzed by using a finite element method assuming that the inner diameter R of an end plate is 5500 mm, the thickness (plate thickness) h of a cylindrical portion is 50 mm, and the thickness (plate thickness) H of the end plate is 25 mm.

In addition, as illustrated in FIGS. 1 and 2, the independent tank 1 according to this embodiment is welded and joined so that a neutral axis (more specifically, the neutral axis of a portion having a constant thickness (a portion excluding a portion (transition portion 4) that has a varying (increased or decreased) plate thickness)) 2*a* of the cylindrical portion 2 is offset from a neutral axis 3*a* of the end plate 3 toward the radial outer side (outer peripheral surface side) by 2 mm.

In addition, reference numeral 5 in FIG. 1 denotes a welded portion, and reference numeral 6 denotes a curvature change portion (boundary line: boundary).

Here, the graph shown in FIG. 2 shows the results analyzed by using a finite element method assuming that the inner diameter R of the end plate 3 is 5500 mm, the thickness (plate thickness) h of the cylindrical portion 2 is 50 mm, and the thickness (plate thickness) H of the end plate 3 is 25 mm. From the results, it can be seen that, when the offset amount δ is −2.0 mm, that is, when the neutral axis (more specifically, the neutral axis of a portion having a constant thickness (a portion excluding a portion (the transition portion 4) that has a varying (increased or decreased) plate thickness)) 2*a* of the cylindrical portion 2 is offset from the neutral axis 3*a* of the end plate 3 toward the radial outer side (outer peripheral surface side) by 2 mm as illustrated in FIG. 1, stress that occurs at the tank outer surface in the welded portion (boundary portion) 5 between the cylindrical portion 2 and the end plate 3 becomes equal to stress that occurs at the tank inner surface, the difference between the stress that occurs at the tank outer surface and the stress that occurs at the tank inner surface becomes zero, and local bending stress does not occur in the vicinity of the welded portion (boundary portion) 5 between the cylindrical portion 101 and the end plate 102.

Here, the "offset amount" is the amount of the plate thickness center of the cylindrical portion 2 being offset with respect to the plate thickness center of the end plate 3.

In addition, from the graph shown in FIG. 2, it can be seen that the difference between the stress that occurs at the tank outer surface and the stress that occurs at the tank inner surface in inner surface alignment in which the offset amount δ is −12.5 mm is smaller than that in outer surface alignment in which the offset amount δ is +12.5 mm.

Figure 3:
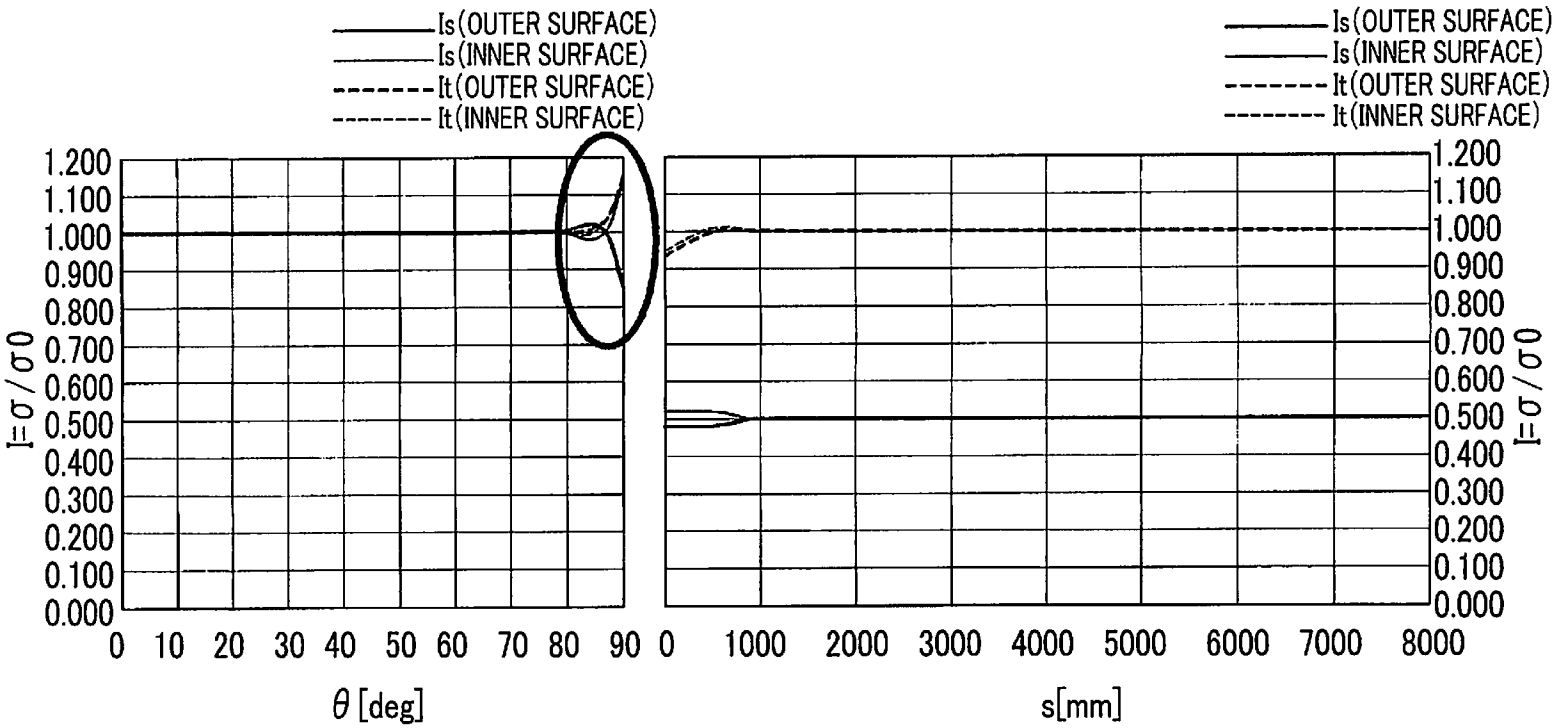
FIG. 3 is a graph showing the results (theoretical values) obtained by using a general theoretical formula assuming that the inner diameter R of the end plate is 5500 mm, the thickness (plate thickness) h of the cylindrical portion is 50 mm, and the thickness (plate thickness) H of the end plate is 25 mm.
Figure 4:
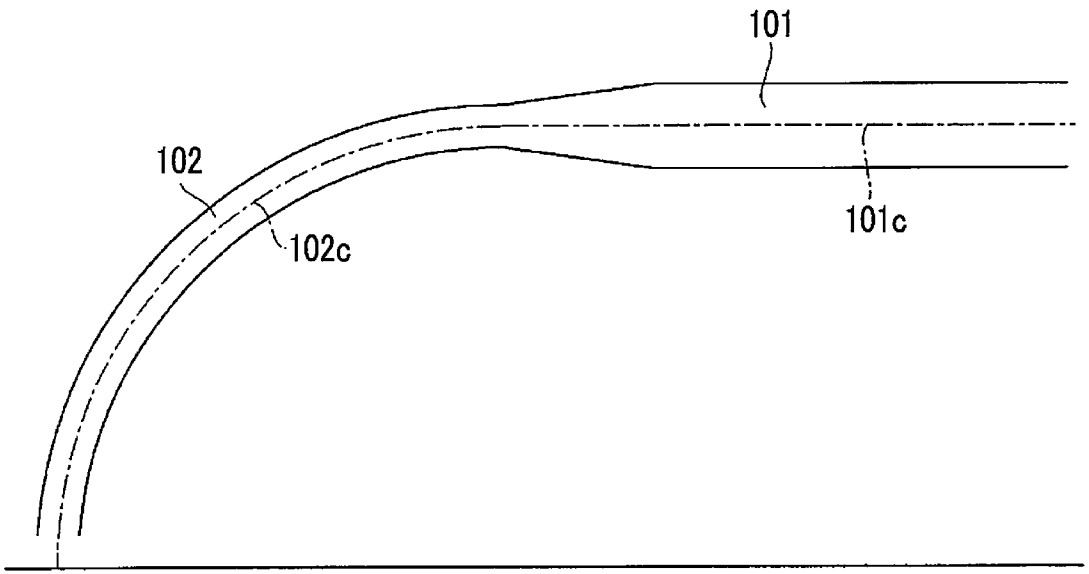
FIG. 4 is an enlarged sectional view illustrating main parts of an independent tank used to derive the results (theoretical values) shown in FIG. 3.
Figure 5:
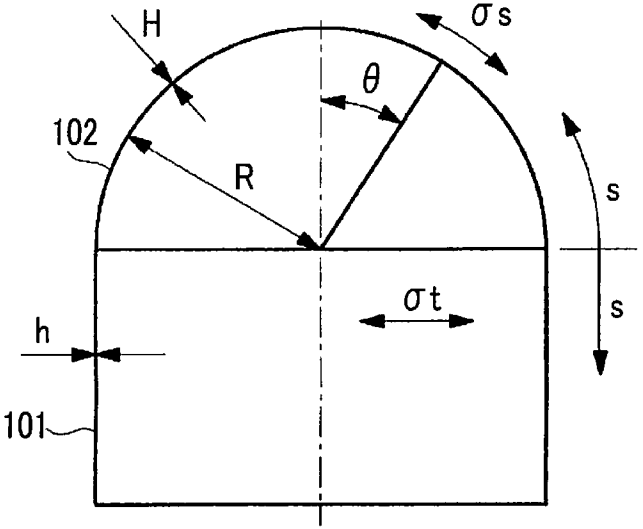
FIG. 5 is a view which shows the summary of the independent tank used to derive the results (theoretical values) shown in FIG. 3 and supplements the meaning of symbols shown in FIG. 3.

In addition, the graph shown in FIG. 3 shows the results (theoretical values) obtained by using a general theoretical formula assuming that, as illustrated in FIG. 4, an end plate 102 is joined to both ends of a cylindrical portion 101 so as to allow a neutral axis 101*c* of the cylindrical portion 101 and a neutral axis 102*c* of the end plate 102 not to be offset from each other but to be coincident with each other (in neutral axis alignment), and as illustrated in FIG. 5, the inner diameter R of the end plate 102 is 5500 mm, the thickness (plate thickness) h of the cylindrical portion 101 is 50 mm, and the thickness (plate thickness) H of the end plate 102 is 25 mm. From the results, it can be seen that, in the vicinity of the boundary portion (welded portion) between the cylindrical portion 101 and the end plate 102, axial direction stress Is (inner surface) that occurs at the tank inner surface becomes higher than axial direction stress Is (outer surface) that occurs at the tank outer surface, and this is coincident with the analytic results shown in FIG. 2, that is, that the stress that occurs at the tank inner surface becomes higher than the stress that occurs at the tank outer surface when the offset amount δ is 0 mm.

Next, a method of manufacturing the independent tank 1 according to this embodiment will be described.

The method of manufacturing the independent tank 1 according to this embodiment includes: a process of preparing the cylindrical portion 2 so that an inner peripheral surface 2*b* of the cylindrical portion 2 is offset toward the radial inner side from a position where inner surface alignment is achieved, and an outer peripheral surface 2*c* of the cylindrical portion 2 is offset toward the radial outer side from a position where outer surface alignment is achieved, and is offset toward the radial outer side to be at a position where stress that occurs at the tank outer surface and stress that occurs at the tank inner surface become equal to each other in the welded portion (boundary portion) 5 between the cylindrical portion 2 and the end plate 3; and a process of joining the end plate 3 and the cylindrical portion 2 together through welding.

According to the independent tank 1 which is manufactured by using the independent tank 1 and the method of manufacturing the same according to this embodiment, as indicated by the black circle mark in FIG. 2, the stress that occurs at the tank outer surface and the stress that occurs at the tank inner surface in the welded portion (boundary portion) 5 between the cylindrical portion 2 and the end plate 3 become equal to each other and the difference between the stress that occurs at the tank outer surface and the stress that occurs at the tank inner surface becomes zero. Therefore, local bending stress that occurs in the vicinity of the welded portion (boundary portion) 5 between the cylindrical portion 2 and the end plate 3 can be removed.

In addition, the present invention is not limited to the above-described embodiment, and can be appropriately modified or changed as necessary.

Figure 6:
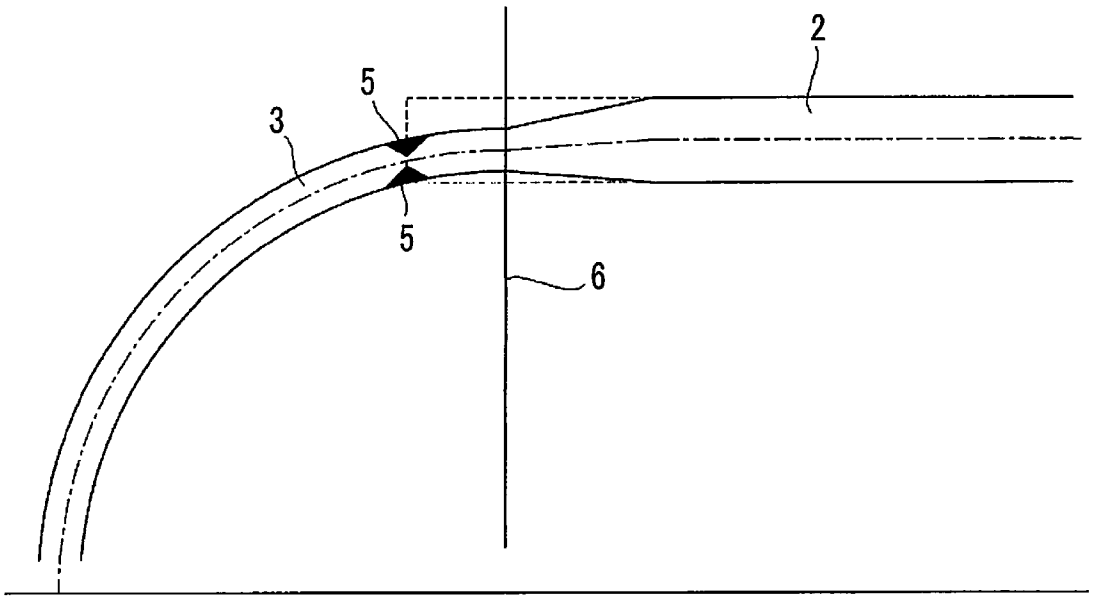
FIG. 6 is an enlarged sectional view illustrating main parts of an independent tank according to another embodiment of the present invention.

For example, as illustrated in FIG. 6, the welded portion 5 may also be shifted toward the apex side of the end plate 3 from the curvature change portion 6 between the cylindrical portion 2 and the end plate 3.

Accordingly, concentration of the local bending stress on the vicinity of the welded portion (joint portion) 5 between the cylindrical portion 2 and the end plate 3 can be avoided, and thus the fatigue life of the welded portion (joint portion) 5 can be prolonged.

In addition, the broken line in FIG. 6 indicates the original shape of the cylindrical portion 2 before being subjected to cutting work.

Figure 7:
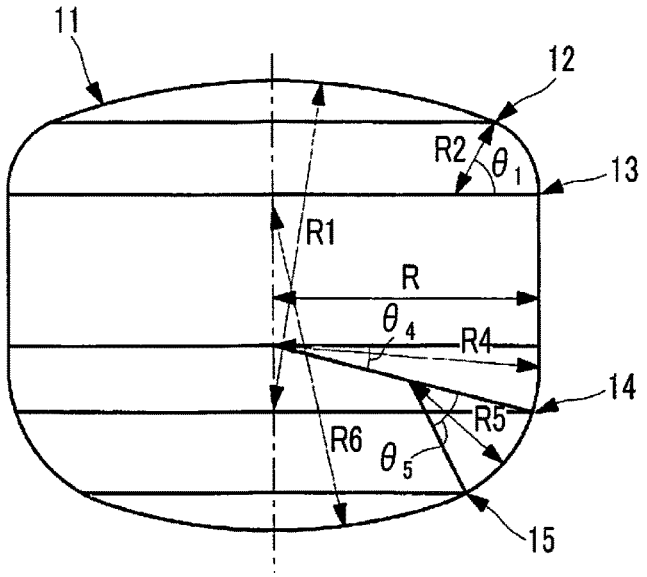
FIG. 7 is a sectional view illustrating the entirety of an independent tank according to another embodiment of the present invention.
Figure 8:
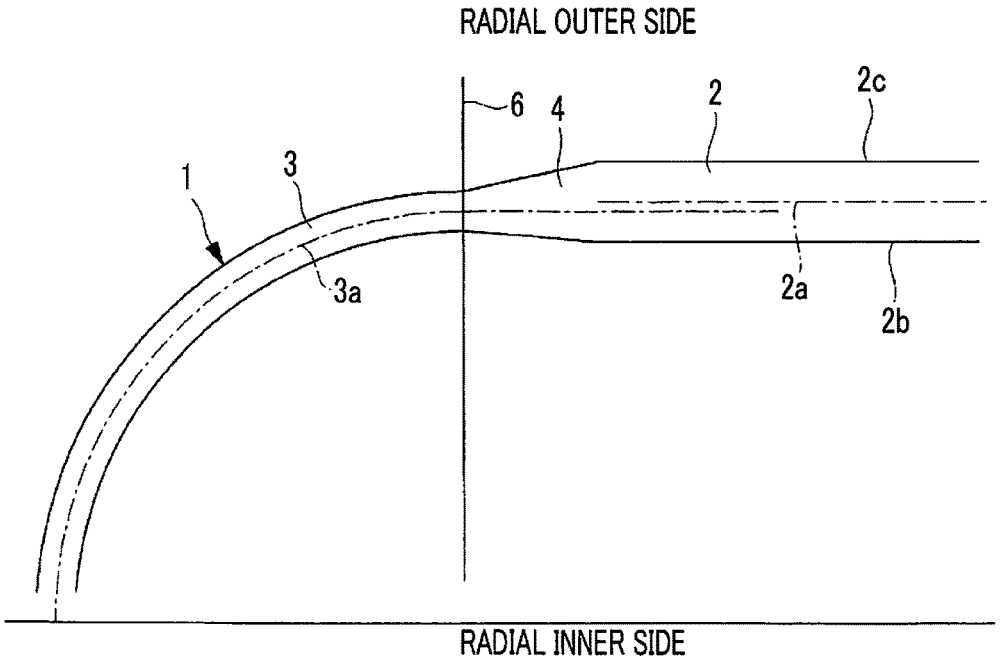
FIG. 8 is an enlarged sectional view illustrating main parts of an independent tank according to another embodiment of the present invention.
Figure 9:
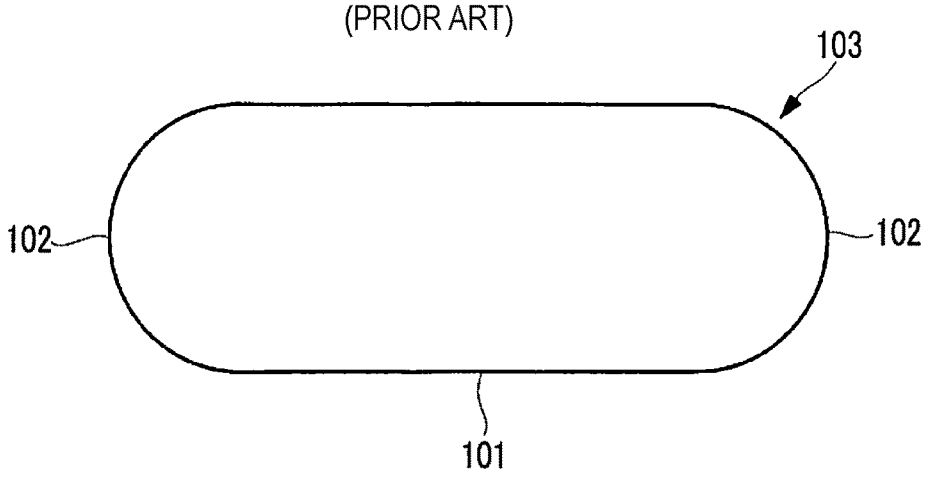
FIG. 9 (PRIOR ART)
FIG. 9 is a view which is used to describe the problems of the present invention and illustrates the exterior of the entirety of an independent tank.
Figure 10:
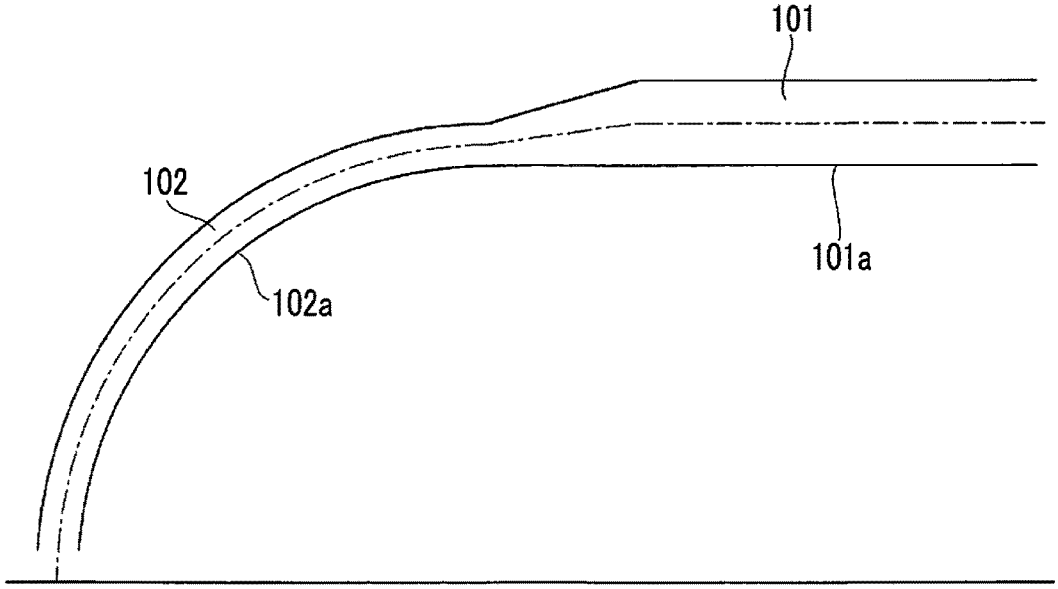
FIG. 10 (PRIOR ART)
FIG. 10 is a view which is used to describe the problems of the present invention and is an enlarged sectional view illustrating main parts of an independent tank in which inner surface alignment is achieved.
Figure 11:
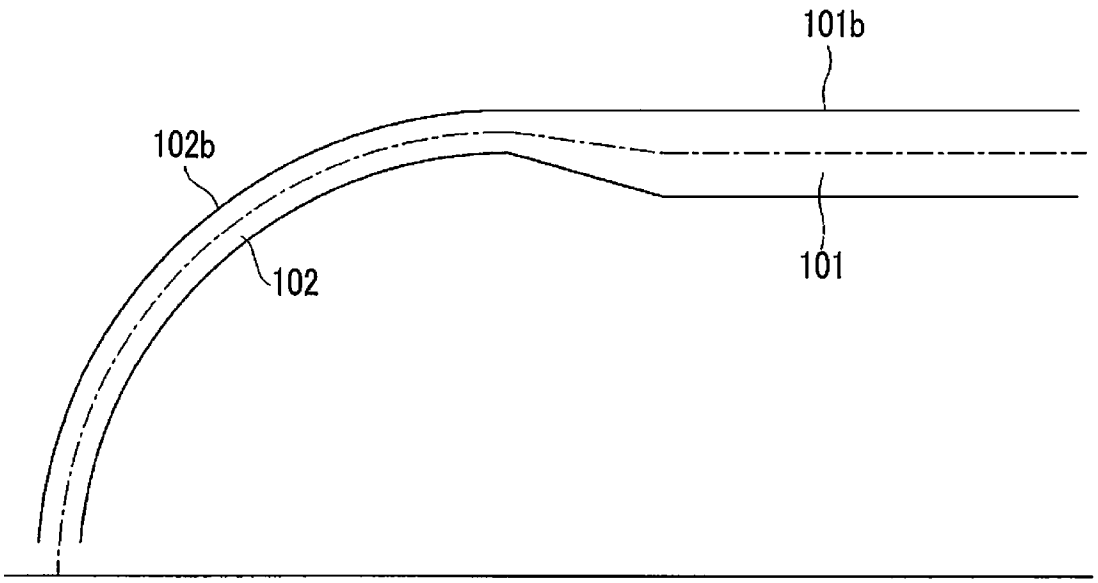
FIG. 11 (PRIOR ART)
FIG. 11 is a view which is used to describe the problems of the present invention and is an enlarged sectional view illustrating main parts of an independent tank in which outer surface alignment is achieved.

In addition, the present invention can be applied to not only the independent tank having the exterior illustrated in FIG. 8 but also any tank having a boundary portion where the curvature changes. For example, the present invention can also be applied to boundary portions 12, 13, 14, and 15 where the curvature R changes in flat spherical shaped tanks (non-spherical tanks 11 loaded on a liquefied gas carrier as illustrated in FIG. 7.

Furthermore, in the above-described embodiment, the independent tank 1 which is welded and joined so that the neutral axis (more specifically, the neutral axis of a portion having a constant thickness (a portion excluding a portion (the transition portion 4) that has a varying (increased or decreased) plate thickness)) 2*a* of the cylindrical portion 2 is offset from the neutral axis 3*a* of the end plate 3 toward the radial outer side (outer peripheral surface side) by 2 mm, that is, the outer peripheral surface 2*c* of the cylindrical portion 2 is offset toward the radial outer side to be at the position where the stress that occurs at the tank outer surface and the stress that occurs at the tank inner surface become equal to each other in the boundary portion between the cylindrical portion 2 and the end plate 3 is described as a specific example. However, the present invention is not limited thereto, and for example, as illustrated in FIG. 8, the inner peripheral surface 2*b* of the cylindrical portion 2 may be offset toward the radial inner side from the position where inner surface alignment is achieved and the outer peripheral surface 2*c* of the cylindrical portion 2 may be offset toward the radial outer side from the position where outer surface alignment is achieved. That is, the offset amount δ may be allowed to only be greater than −12.5 mm and smaller than +12.5 mm.

Accordingly, the difference between the stress that occurs at the tank outer surface and the stress that occurs at the tank inner surface in the welded portion (boundary portion) 5 between the cylindrical portion 2 and the end plate 3 becomes less than when inner surface alignment or the outer surface alignment is achieved. Therefore, in the above-described manner, local bending stress that occurs in the vicinity of the welded portion (boundary portion) 5 can be reduced without an increase in plate thickness.

In addition, the inner peripheral surface 2*b* of the cylindrical portion 2 may be offset toward the radial inner side from the position where inner surface alignment is achieved, and the outer peripheral surface 2*c* of the cylindrical portion 2 may be offset toward the radial outer side from the position where outer surface alignment is achieved and may be offset toward the radial outer side from the position where the stress that occurs at the tank outer surface and the stress that occurs at the tank inner surface in the welded portion (boundary portion) 5 between the cylindrical portion 2 and the end plate 3 become equal to each other. That is, the offset amount δ may be allowed to be greater than −12.5 mm and equal to or smaller than −2.0 mm.

Accordingly, in the welded portion (boundary portion) 5 between the cylindrical portion 2 and the end plate 3, the stress that occurs at the tank outer surface is reliably (always) higher than the stress that occurs at the tank inner surface. Therefore, in a case where cracks and the like are generated in the welded portion (boundary portion) 5 between the cylindrical portion 2 and the end plate 3, the cracks and the like are generated from the tank outer surface side. Accordingly, cracks and the like can be easily and rapidly found from the tank outer surface side.

Moreover, the inner peripheral surface 2*b* of the cylindrical portion 2 may be offset toward the radial inner side from the position where inner surface alignment is achieved and may be offset toward the radial inner side from a position where a manufacturing error is considered, and the outer peripheral surface 2*c* of the cylindrical portion 2 may be offset toward the radial outer side from the position where outer surface alignment is achieved. That is, in a case where the manufacturing error is set to ±3 mm, the offset amount δ may be allowed to be equal to or greater than −8.0 mm and equal to or smaller than −2.0 mm.

Accordingly, the difference between the stress that occurs at the tank outer surface and the stress that occurs at the tank inner surface in the welded portion (boundary portion) 5 between the cylindrical portion 2 and the end plate 3 is further reduced. Therefore, local bending stress that occurs in the vicinity of the welded portion (boundary portion) 5 can be further reduced.

Furthermore, in the above-described embodiment, the independent tank 1 in which the cylindrical portion 2 and the end plate 3 are joined together by welding is described as a specific example. However, the present invention is not limited thereto, and for example, as illustrated in FIG. 8, can also be applied to the independent tank 1 in which the cylindrical portion 2 and the end plate 3 are not joined together by welding, that is, the cylindrical portion 2 and the end plate 3 are produced in one body.

REFERENCE SIGNS LIST

1: independent tank
2: cylindrical portion
2*a*: neutral axis
2*b*: inner peripheral surface
2*c*: outer peripheral surface
3: end plate
3*a*: neutral axis
5: welded portion (boundary portion)
6: curvature change portion (boundary line: boundary)

The invention claimed is:

1. An independent tank comprising:

at least one curvature change portion in which a curvature along an axial direction of plate members that form the tank changes along the axial direction;

a first plate member including a transition portion that has a varying plate thickness toward an end, the first plate member having a cylindrical shape;

a second plate member having a higher curvature along the axial direction than the first plate member, the second plate member having a hemispherical shape, wherein the end of the first plate member and an end of the second plate member are joined together, both an inner peripheral surface and an outer peripheral surface of the first plate member are not flush with an inner peripheral surface and an outer peripheral surface of the second plate member, respectively, and a plate thickness center of the first plate member is offset toward a radial inner side or a radial outer side with respect to a plate thickness center of the second plate member.

2. The independent tank according to claim 1, wherein the plate thickness center of the first plate member is offset toward the radial outer side from a position where stress that occurs at an outer surface of the tank and stress that occurs at an inner surface of the tank become equal to each other with respect to the plate thickness center of the second plate member.

3. The independent tank according to claim 1, wherein the plate thickness center of the first plate member is offset toward the radial outer side from a position where stress that occurs at an outer surface of the tank and stress that occurs at an inner surface of the tank become equal to each other.

4. The independent tank according to claim 1, wherein the plate thickness center of the first plate member is offset toward the radial outer side from the plate thickness center of the second plate member to be at a position where stress that occurs at an outer surface of the tank and stress that occurs at an inner surface of the tank become equal to each other.

5. The independent tank according to claim 1, wherein a welded portion between the first plate member and the second plate member is shifted toward a side of the second plate member from the curvature change portion between the first plate member and the second plate member.

6. The independent tank according to claim 1, wherein the second plate member is an end plate.

7. The independent tank according to claim 1, loaded on a ship or an offshore structure.

8. A ship with the independent tank according to claim 1, loaded thereon.

9. A method of manufacturing an independent tank which includes at least one curvature change portion in which a curvature along an axial direction of plate members that form the tank changes along the axial direction, a first plate member including a transition portion that has a varying plate thickness toward an end, the first plate member having a cylindrical shape, and a second plate member having a higher curvature along the axial direction than the first plate member, the second plate member having a hemispherical shape, the method comprising the processes of:

preparing the first plate member so that both an inner peripheral surface and an outer peripheral surface of the first plate member are not flush with an inner peripheral surface and an outer peripheral surface of the second plate member having a higher curvature, respectively, and a plate thickness center of the plate member is offset toward a radial inner side or a radial outer side with respect to a plate thickness center of the second plate member; and joining the end of the first plate member and an end of the second plate member having a higher curvature together.

10. A method of manufacturing an independent tank which includes at least one curvature change portion in which a curvature along an axial direction of plate members that form the tank changes along the axial direction, a first plate member including a transition portion that has a varying plate thickness toward an end, the first plate member having a cylindrical shape, and a second plate member having a higher curvature along the axial direction than the first plate member, the second plate member having a hemispherical shape, the method comprising the processes of:

preparing the first plate member so that both an inner peripheral surface and an outer peripheral surface of the first plate member are not flush with an inner peripheral surface and an outer peripheral surface of the second plate member, respectively, and a plate thickness center of the first plate member is offset toward a radial outer side from a position where stress that occurs at an outer surface of the tank and stress that occurs at an inner surface of the tank become equal to each other, with respect to a plate thickness center of the second plate member; and joining the first plate member and the second plate member together.

11. A method of manufacturing an independent tank which includes at least one curvature change portion in which a curvature along an axial direction of plate members that form the tank changes along the axial direction, a first plate member including a transition portion that has a varying plate thickness toward an end, the first plate member having a cylindrical shape, and a second plate member having a higher curvature along the axial direction than the first plate member, the second plate member having a hemispherical shape, the method comprising the processes of:

preparing the first plate member so that both an inner peripheral surface and an outer peripheral surface of the first plate member are not flush with an inner peripheral surface and an outer peripheral surface of the second plate member, respectively, and a plate thickness center of the first plate member is offset toward a radial outer side from a position where stress that occurs at an outer surface of the tank and stress that occurs at an inner surface of the tank become equal to each other, with respect to a plate thickness center of the second plate member; and joining the first plate member and the second plate member together.

12. A method of manufacturing an independent tank which includes at least one curvature change portion in which a curvature along an axial direction of plate members that form the tank changes along the axial direction, a first plate member including a transition portion that has a varying plate thickness toward an end, the first plate member having a cylindrical shape, and a second plate member having a higher curvature along the axial direction than the first plate member, the second plate member having a hemispherical shape, the method comprising the processes of:

preparing the first plate member so that both an inner peripheral surface and an outer peripheral surface of the first plate member are not flush with an inner peripheral surface and an outer peripheral surface of the second plate member, respectively, and a plate thickness center of the first plate member is offset toward a radial outer side from a plate thickness center of the second plate member to be at a position where stress that occurs at an outer surface of the tank and stress that occurs at an inner surface of the tank become equal to each other; and joining the first plate member and the second plate member having a higher curvature together.

13. The method of manufacturing an independent tank according to claim 9, wherein a welded portion between the first plate member and the second plate member is shifted toward a side of the second plate member from the curvature change portion between the first plate member and the second plate member.

* * * * *